US007434881B1

(12) United States Patent
Wegener

(10) Patent No.: US 7,434,881 B1
(45) Date of Patent: Oct. 14, 2008

(54) DYNAMIC CHAIR

(76) Inventor: William E. Wegener, 298 Casitas Bulevar, Los Gatos, CA (US) 95032

( * ) Notice: Subject to any disclaimer, the term of this patent is extended or adjusted under 35 U.S.C. 154(b) by 0 days.

(21) Appl. No.: 11/742,386

(22) Filed: Apr. 30, 2007

Related U.S. Application Data

(63) Continuation-in-part of application No. 11/333,948, filed on Jan. 17, 2006, now Pat. No. 7,216,935, which is a continuation of application No. 11/088,011, filed on Mar. 22, 2005, now Pat. No. 7,008,017.

(60) Provisional application No. 60/581,099, filed on Jun. 17, 2004.

(51) Int. Cl.
*A47C 3/00* (2006.01)

(52) U.S. Cl. ..... 297/330; 297/314

(58) Field of Classification Search ..... 297/217.1, 297/217.3, 313, 314, 330, 337
See application file for complete search history.

(56) References Cited

U.S. PATENT DOCUMENTS 4,650,247 A * 3/1987 Berg et al. ..... 297/284.1
5,088,473 A * 2/1992 Chen et al. ..... 601/26
5,113,851 A * 5/1992 Gamba ..... 297/330
5,588,704 A * 12/1996 Harza ..... 297/314
5,735,575 A * 4/1998 Harza ..... 297/314
5,976,097 A * 11/1999 Jensen ..... 297/330
6,033,021 A * 3/2000 Udo et al. ..... 297/313
6,139,095 A * 10/2000 Robertshaw ..... 297/105
6,644,745 B2 * 11/2003 Rogers et al. ..... 297/344.2
2002/0027384 A1 * 3/2002 Zur ..... 297/452.41
2004/0035347 A1 * 2/2004 Grober ..... 114/191

* cited by examiner

*Primary Examiner*—Peter R. Brown
(74) *Attorney, Agent, or Firm*—John W. Crosby

(57) ABSTRACT

A dynamic chair providing automatic motion in a seat. The chair has bottom, a support means disposed between the base and the seat bottom, a drive motor. A first drive wheel driven by the drive motor has a first mounting point offset from a first distance from the center of the first drive wheel; a second drive wheel driven by the first drive wheel, the second drive wheel having a different diameter from the diameter of the first drive wheel; and a crankshaft having a first crankshaft end and a second crankshaft end, the first crankshaft end connected to the second drive wheel and rotatably driven by the second drive wheel, the second crankshaft end having an eccentric providing a second offset mounting point offset from a second distance from the center of the second crankshaft end.

17 Claims, 19 Drawing Sheets

FRONT TILTING AND ROTATING ASSEMBLY WITH SEAT

SHAFT AT 0° AND 360°

SHAFT AT 90°

SHAFT AT 180°

SHAFT AT 270°

DYNAMIC CHAIR

RELATED APPLICATION

This application is a Continuation-in-Part of co-pending patent application Ser. No. 11/333,948, filed Jan. 17, 2006, which is a Continuation of patent application Ser. No. 11/088,011, filed Mar. 22, 2005, now issued as U.S. Pat. No. 7,008,017, which claims priority to U.S. Provisional Patent Application Ser. No. 60/581,099, filed Jun. 16, 2004, the entirety of are hereby incorporated by reference herein.

FIELD

The present invention relates broadly to chairs having powered motion. Specifically, the present invention relates to a chair seat that travels through a preferred range of motion to distribute pressure over a large area beneath a seated person and to induce dynamic motion in the lower back of a seated person.

BACKGROUND

In a seated position, a very small area under the buttocks supports the majority of a person's weight. In this small area, capillaries and soft tissue are compressed. Blood circulation is restricted and soft tissue is put under stress. Prolonged sitting over time can damage the tissue being compressed. The simple solution is to avoid sitting for prolonged periods, but such a solution is not realistic for many people who must sit for prolonged periods to perform many necessary functions such as driving or working.

Two major factors that contribute to the physical detriments described above are time and compressive pressure. Reducing one or both of these factors reduces the stress on the soft tissue. If the compressive pressure under the buttocks is shifted back and forth between two locations, then the duration of compressive pressure experienced at one position is reduced by half. This would allow some measure of periodical relief of the pressure points. If the compressive pressure point could be rotated between several positions over time, then the time of tissue stress at each position can be further reduced. As the number of pressure points is increased, the period of stress is reduced at each pressure point. In order to obtain the maximum number useful pressure points, the pressure points need to be evenly distributed over the entire buttocks area.

One solution to this problem is a seat that tilts in two dimensions with a pivot that is located under the center of the seat. Such a seat can continuously rotate in a circular manner, thus distributing pressure over a large number of pressure points, as shown in the motion path illustrated in FIG. 1. The problem with this method is that all pressure points are limited to only one circular path under the buttocks area. This simple motion path misses the majority of possible pressure point locations.

U.S. Pat. No. 5,976,097 to Jensen and U.S. Pat. No. 5,113,851 to Gamba both disclose a chair having a seat that is permanently tilted at a fixed angle with respect to the center of the seat. The chair seat is motor-driven to rotate this tilted fixed angle in a circular manner with respect to the center of the seat. It is important to point out that the seat does not rotate. It is the seat's tilting fixed angle that rotates around the center of the seat. The direction of this circular tilting motion remains constant and the circular tilt pattern repeats identically on each rotation. Since the seat is always tilted, the seat needs to be always in motion or a seated person will be sitting in a twisted fashion, trying to compensate for the static, tilted nature of the chair. While the purpose of the chairs described in Jensen and Gamba is to prevent sitting in a static position and thus holding the same posture for prolonged period of time, sitting in these chairs requires continuous posture adjustments. FIG. 1 illustrates a graphical plot of the circular tilted motion generated by the chairs described in Jensen and Gamba. At location 1, seat 10 is tilted backwards only, as shown in FIGS. 2A and 2B. At location 2 of FIG. 1, seat 10 is tilted to the right side only, as shown in FIGS. 3A and 3B. At location 3 of FIG. 1, seat 10 is tilted to the right and tilted forward, as illustrated in FIGS. 4A and 4B. At location 4 of FIG. 1, seat 10 is tilted forward only, as shown in FIGS. 5A and 5B. For seat 10 to be level, as shown in FIGS. 6A and 6B, seat 10 travels through a path taking it through location 5 of FIG. 1. But because the seats of Jensen and Gamba rotate at a fixed angle, they never pass through this horizontal position.

While Jensen and Gamba both address part of the problem described above, and it is desirable for a seated person to change posture and not sit in a static position for extended periods of time, it is not desirable to be forced to make continuous postural changes while seated over prolonged periods of time. Due to the fixed angle of the chairs described in Jensen and Gamba and their inability to ever become level, these seats always need to be moving, thus requiring constant posture changes for a seated person, and the seat cannot be used as a regular level chair. Also, neither Jensen nor Gamba disclose or suggest any manner in which the seat can be easily stopped, or how the seat can be stopped periodically.

U.S. Pat. No. 6,033,021 to Udo discloses a self-tilting seat that utilizes two independent, unsynchronized tilting mechanisms to generate a path from two separate motors. There is no disclosure in Udo for detecting a level position. If a level position of the seat is ever reached it is achieved randomly, and not in a repeatable manner, as the two independent tilting mechanisms are not synchronized. There is a heartfelt need for a dynamic chair having a repeatable and deterministic motion path to generate a known range of postural changes to alleviate compressive pressure at as many pressure points as possible.

SUMMARY OF THE INVENTION

The present invention provides a dynamic chair having a deterministic motion path that allows a variety to different paths to be selected depending of needs of user. By changing the ratio between drive wheels that control the pitch, roll and yaw of the seat, motion paths can be selected to help a person assume and/or avoid certain postures while seated. Embodiments of the present invention move the seat of the dynamic chair through a deterministic path to dictate how often and when the seat is in a level position with respect to pitch and roll.

The present invention provides a dynamic chair providing automatic motion in a seat. The chair includes a Chair seat, a Motor Drive, a motorized dynamic Tilting and rotating Assembly, a backrest, two stationary arm rests, a manual tilting mechanism, a chair adjustable center post, chair base and a Microcomputer Controller. The seat is attached to the top of the Dynamic Tilting and rotating Assembly. Under the Dynamic tilting and rotating assembly is the manual tilting and height adjustment mechanism. The stationary member of the manual chair tilting and height adjustment mechanism is connected to the chair's adjustable center post, and backrest. The tilting member of the manual chair tilting and height adjustment mechanism is connected to the chair's two arm rests. The center post bottom is attached to the chair's wheeled base. The motorized chair tilting and rotating assembly consist of a back tilting assembly and a front tilting and rotating assembly. The front tilting assembly is driven by the motor drive through a first roller chain. A second roller chain connects the front seat tilting and rotating assembly to the back tilting assembly. The second roller chain connects the front ratiometric drive wheel to the back ratiometric drive wheel. A ratiometric drive wheel is a fixed drive ratio between two such wheels. These two ratiometric drive wheels are configured in a none equal ratio of diameters within a range of 20.0:1.0 and 1.0:20.0, such that a changing, substantially ellipsoidal tilting pattern of movement is produced in the seat.

The back tilting assembly has a first distance, which is the difference between the high, and low points on a cam. The front tilting and rotational assemble has a second distance which is the sum to the first and second offset points to the center of the two eccentrics respectfully. The first distance determines a range of pitch of the seat's first rotational degree of freedom. The seat's first rotational degree of freedom, pitch, is a front to back tilt. The second distance determines a range of roll and yaw of the seat's second and third degree rotational degree of freedom respectfully. The seat's second and third rotational degree of freedom is tilt left to right and clockwise to counterclockwise rotation with respect to the center of the front tilting and rotating assembly. The first, second and third ranges of rotational freedom are within −5 degrees to +5 degrees.

In an embodiment, the chair has a tilting plane, which is a fixed vertical distance below the seat on center of the axes of rotation of the front tilting and rotational assembly, i.e. pivot point. The seat bottom is attached in two locations to the chair front tilting and rotational assembly and at one location on the back tilting assembly. When the seat moves in the first and second degree of rotational freedom, i.e. roll and pitch, this fixed vertical distance produces a first degree of linear freedom of horizontal movement for the seat and a second degree of linear freedom of horizontal motion for the seat. The first degree of freedom of linear motion orthogonal to the second degree of freedom of linear movement. The length of the fixed distance determines a radial distance from the pivot point in the chair tilting assembly to the seat, so that as the chair tilting assembly rotates, the radial distance and a rotational angle of the pivot point determine a first linear travel distance for the first degree of freedom of linear motion and a second linear travel distance for the second degree of freedom of linear motion. The horizontal distances of the linear travel of the seat is within range of +/−1.0 inch.

In an embodiment, the front ratiometric wheel is connected to a drive shaft with an eccentric attached at each end of the drive shaft. The two eccentrics offset points are by opposed 180 degrees. Each eccentric is connected to a rod end. The two rod ends are connected the bottom of seat at a front right and front left location. The back ratio metric drive sprocket is attached to a cam that rides on a cam follower. The cam is connected to the bottom of seat at back center, thorough a tilt arm, tilt bearing and tilt bearing guide. The motion produced is essentially a series of changing ellipsoidal tilting patterns of movement, such as a Lissajou pattern, with an oscillation clockwise and counterclockwise yaw motion of the seat.

In various embodiments, the dynamic chair of the present invention can include a motor speed controller that controls the rotational speed of the motor drive wheel, a motor timer that provides periodic motor stop time, and a plurality of level sensors that indicate that the seat is level with respect to pitch and roll so that the chair motion can be temporarily halted when the seat is level. A seat occupied sensor is used to enable the drive motor when the chair is occupied and stop the drive motor when the seat is empty. The useful speed range of the seat is between 0.1 rpm and 20 rpm.

In an embodiment a microcomputer may be employed to run a user-selected series variable motion speed and motion direction programs.

In an embodiment as the seat tilts and rotates the backrest and two armrests are stationary.

Many other features and advantages of the present invention will be realized upon reading the following detailed description, when considered in conjunction with the accompanying drawings.

DETAILED DESCRIPTION

Figure 7:
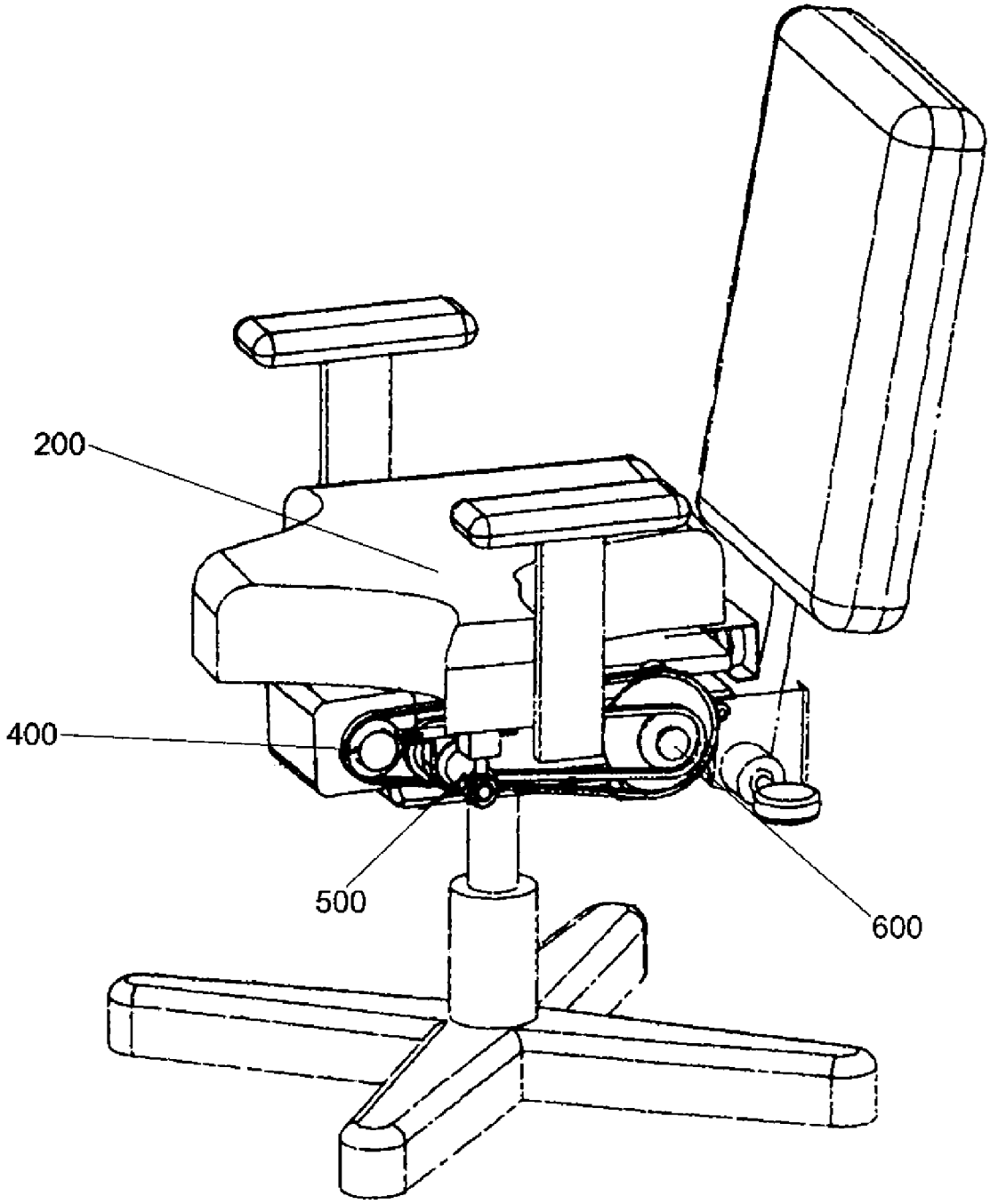
FIG. 7 illustrates the dynamic chair of the present invention.
Figure 8A:
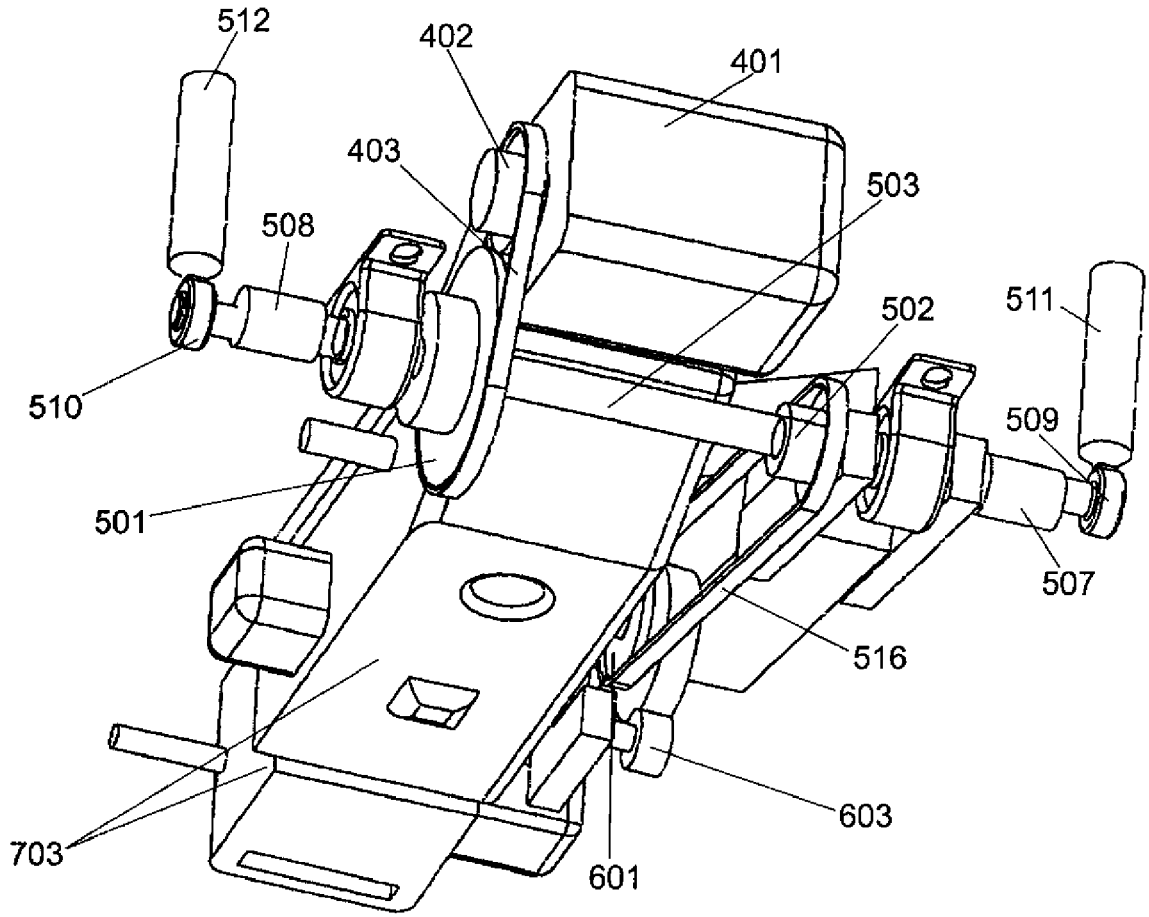
FIG. 8A illustrates a front bottom view of the motor driven tilting assembly without seat.

Directing attention to FIG. 7, the present invention provides chair 100 having seat 200 that is manipulated through a large number of different tilting and rotating motion paths. The seat moves in a synchronized motion path employing two or more degrees of freedom, depending on the embodiment. Directing attention to FIG. 8A, the chair seat motion is driven by gear motor 401 and attached motor sprocket 402 through roller chain 403 to speed modification sprocket 501. Speed modification sprocket 501 drives front drive shaft 503, which drives the first ratiometric sprocket 502. Directing attention to FIG. 8B, first ratio metric sprocket 502 drives a second roller chair 516, which is connected, to second ratio metric sprocket 601.

Drive shaft 503 (FIG. 8A), is attached to eccentrics 507 and 508. Rod ends 509 and 510 are attached to eccentrics 507 and 508 respectively at offset points on the eccentrics. The offset points on eccentrics 507, 508 are positioned so they are disposed at 180 degrees in relation to each other through connecting drive shaft 503. Attached to the second end of the rods ends 509, 510 are rod end mounts 511, 512 respectively which are mounted to the seat bottom 200. Rod ends 509, 510 screw into end rod mounts 511, 512 and are adjustable in length.

Figure 8B:
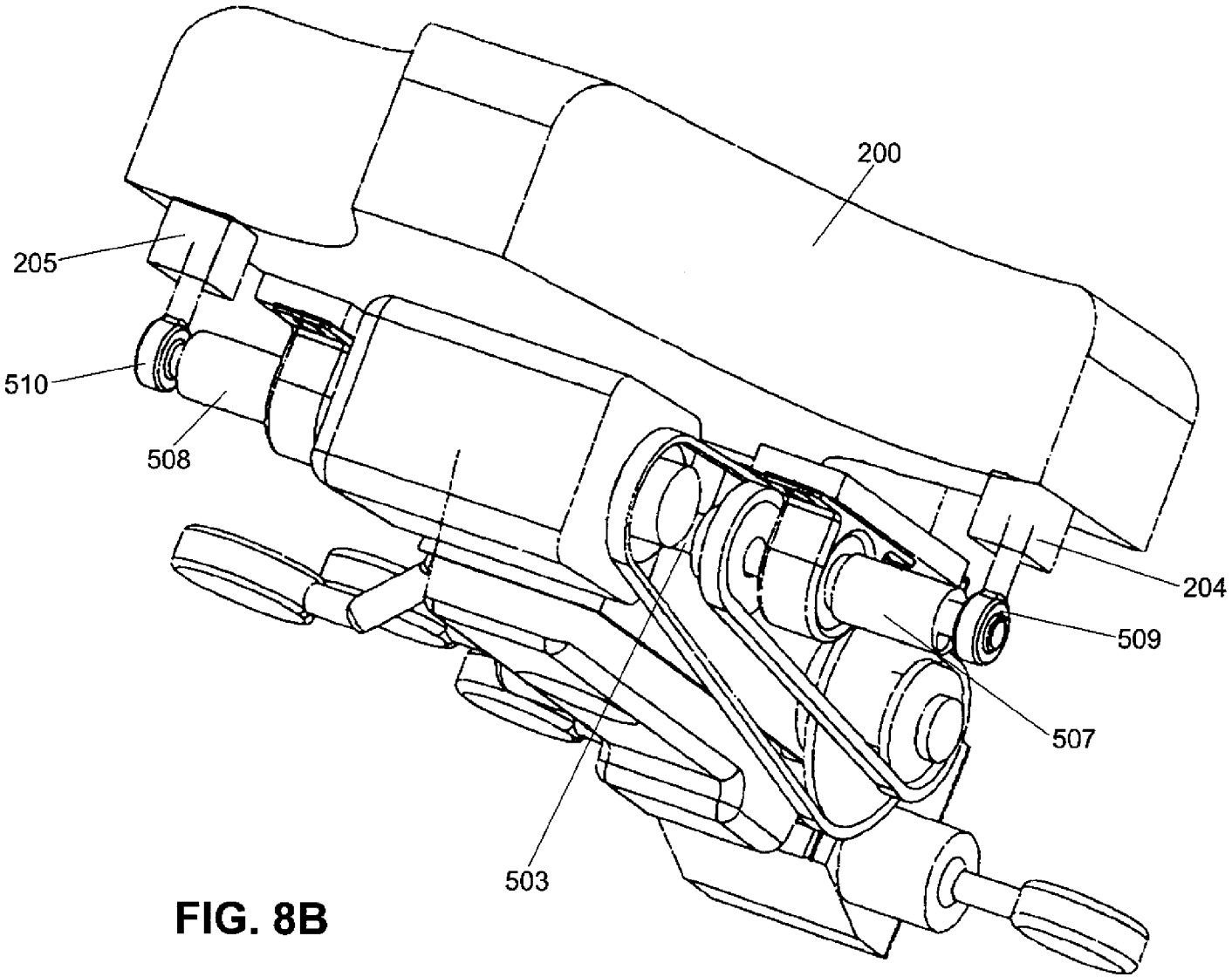
FIG. 8B illustrates a top side view of the dynamic chair without seat.

Directing attention to FIG. 8B, the first ratiometric sprocket 502 drives the second roller chain 516 which drives the second ratiometric sprocket 601. The second ratiometric sprocket 601 is attached to cam 606 and both are mounted to tilt arm 602 that pivots on drive shaft 503. Cam 606 rides on cam follower 603. Cam follower 603 is mounted in a fixed position to manual tilt and height mechanism 703. When cam 606 rotates, tilt arm 602 moves up and down in an arc of five degrees of motion.

Tilt bearing 604 is attached to tilt arm 602 and moves up and down in an arc as cam 606 rotates. Directing attention to FIG. 8C, tilt bearing 604 rides in seat bearing guide 607. Seat bearing guide is attached to bottom of seat 200. Tilt bearing 604 transfers up and down motion to the back of the seat 200 thru seat bearing guide 607. As the back of seat 200 moves up and down, seat 200 pivots on end rods 509, 510 producing a front to back tilting motion of seat 200. Seat 200 and attached bearing guide 607 are free to move left or right without hindrance from tilt bearing 604. This is preferred for seat rotation.

Figure 9A:
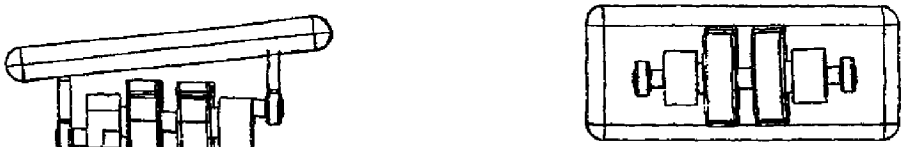
FIG. 9A illustrates the front tilting and rotating assembly at 0 degrees.
Figure 9B:
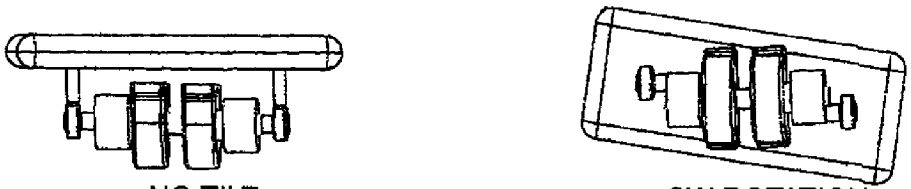
FIG. 9B illustrates the tilting and rotating assembly at 90 degrees.
Figure 9C:
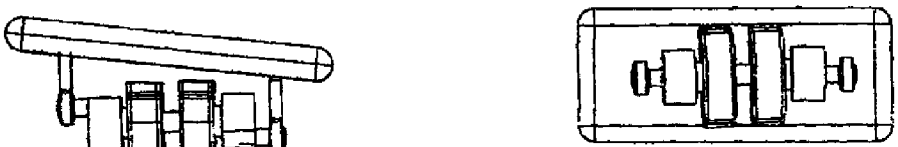
FIG. 9C illustrates the front tilting and rotating assembly at 180 degrees.
Figure 9D:
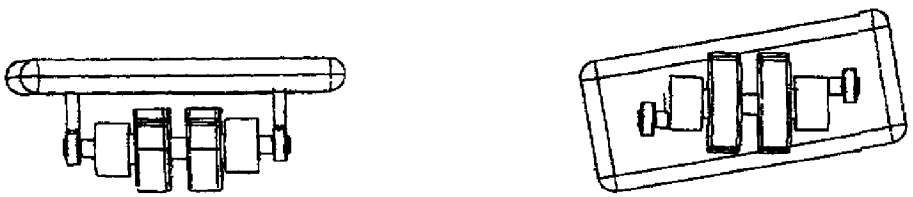
FIG. 9D illustrates the right left tilting and rotating assembly at 270 degrees.

Directing attention to FIG. 8B, as shaft 503 rotates 1 cycle or 0 to 360 degrees, seat 200 tilts and rotates, ie. yaw, roll and pitch in the following manor. Directing attention to FIG. 9A, shaft 503 is rotated to 0 degrees, seat 200 is tilting left with no rotation. In FIG. 9B, shaft 503 is rotated to 90 degrees; seat 200 is not tilting, but has counter clockwise rotation. In FIG. 9C, shaft 503 is rotated to 180 degrees; seat 200 is tilting right with no rotation. In FIG. 9D, shaft 503 is rotated to 270 degrees, seat 200 is not tilting, but has counter clockwise rotation. In FIG. 9A, shaft 503 is rotated to 360 degrees in which the cycle ends and starts over again. As the repeating tilting cycle continues 0 to 360 degrees, seat 200 rotates clockwise and counterclockwise around a pivot point, which is below seat 200. Please note, as the seat 200 rotates clockwise/counterclockwise and tilts left/right the seat also is tilting front/back.

Directing attention to FIG. 8B the ratio between the diameters of the ratiometric sprockets 502, 601 determines the motion paths for seat 200 in FIG. 7. If the diameters of sprockets 502, 601 are equal, a circular tilting pattern occurs and the seat is never in a horizontal position. Thus, in a preferred embodiment, drive wheels 502, 601 are of different diameters to generate a periodic path of varying ellipsoidal tilting motions. The number of tilting motion iterations per repeating pattern is determined by the ratio between sprockets 502, 601. If the ratio is not equal the seat of the chair will be horizontal or nearly horizontal a minimum of two times during each period. In a preferred embodiment, the present invention utilizes a ratio of 6:7 between sprockets 502, 601. A useful range of ratios is about 1:20 to about 20:1, excluding the ratio of 1:1. A ratio close to 1:1 will make the number of roll to pitch tilts per repeating motion path more equal.

Directing attention to FIG. 7, in an embodiment, seat 200 supported by the front tilting and rotational assembly 500 and the back tilting assembly 600. While in motion, front tilting and rotational assembly 500 allows seat 200 to pivot about a central point located in the center of and at midpoint on drive shaft 503 between rod ends 509 and 510. A fixed vertical position is the distance between the central point of drive shaft 503 and the top of seat 200 in FIG. 7. When the seat moves in the first and second degree of rotational freedom, this fixed vertical distance produces a first degree of linear freedom of horizontal movement for the seat and a second degree of linear freedom of horizontal motion for the seat. The first degree of freedom of linear motion orthogonal to the second degree of freedom of linear movement. The length of the fixed vertical distance determines a radial distance from the pivot point in the chair tilting assembly to the top of seat 200, so that as the chair tilting assembly tilts, the radial distance and a rotational angle of the pivot point determine a first linear travel distance for the first degree of freedom of linear motion and a second linear travel distance for the second degree of freedom of linear motion. The horizontal distances of the linear travel of the seat is within a range of +/−1.0 inch.

Figure 8C:
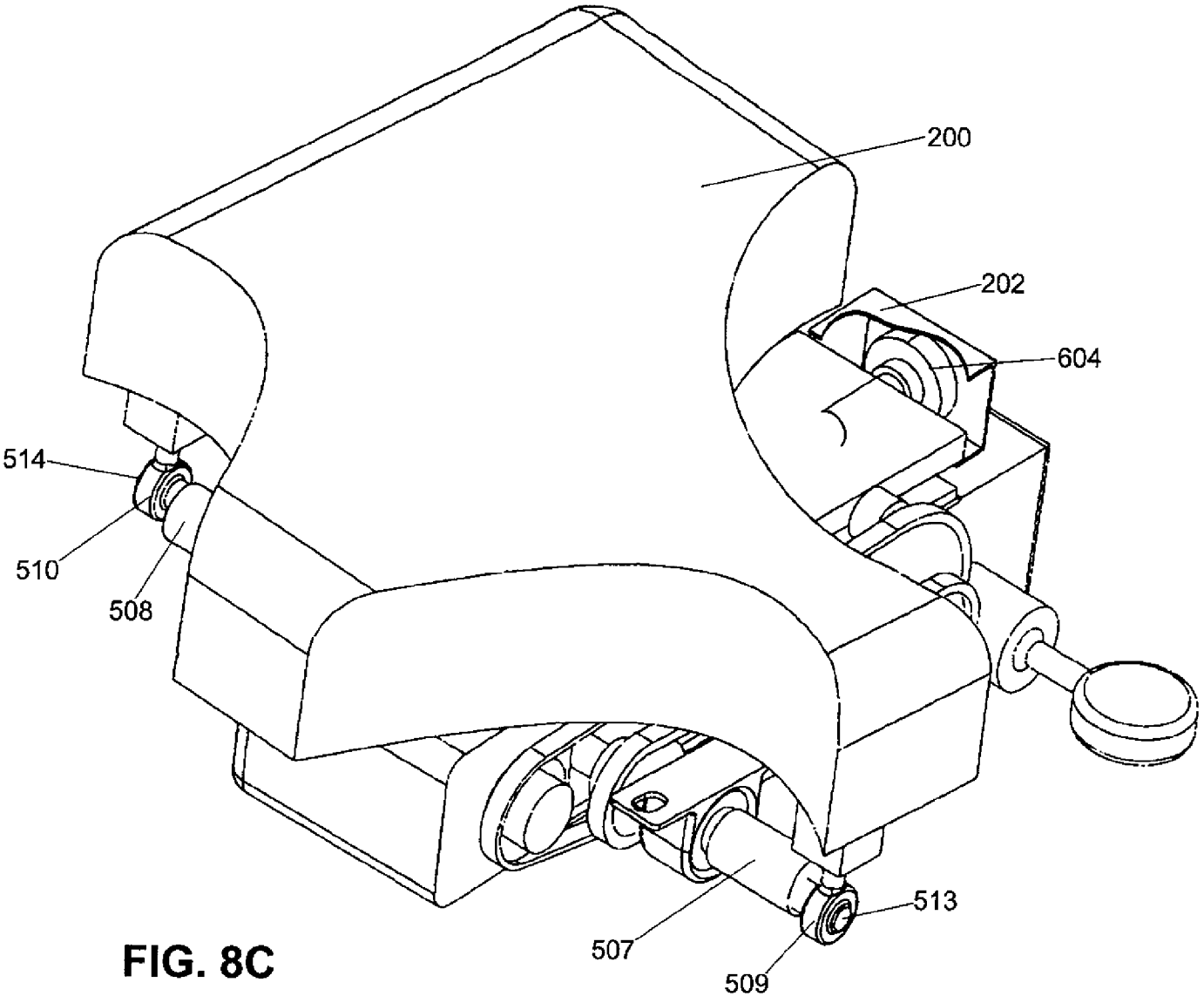
FIG. 8C Illustrates a side top view of the dynamic chair with seat attached.

In FIG. 8C, eccentrics 507, 508 may have a plurality of off-center mounting points located at different, but equal radii from the center of rotation, to provide adjustments to the magnitude of seat 200 left and right tilt changes, horizontal motion changes, and rotational changes to seat 200.

Directing attention to FIG. 8B, the offset of cam 606 may have a plurality of offset distances depending of the difference between low and high points on the cam. This variation in offset distances is to provide adjustments to the magnitude of seat 200 back and front tilt changes and horizontal motion changes to seat 200 by linkages i.e. cam 606, tilt arm 602, tilt bearing 604 and seat bearing guide way 607 respectively.

While in a preferred embodiment, drive wheels 402, 501, 502, and 601 are sprockets that are connected by roller chains 403, 516 in alternative embodiment drive wheels 402, 501, 502, and 601 are pulleys and belts 403, 516 In another embodiment, drive wheels 402, 501, 502, and 601 can be gears that interface directly with each other, or through intermediate gearing. In yet another embodiment, drive wheels 502, 601 be independently powered by separate drive motors that turn drive wheels 502, 601 at respective rotational speeds to achieve the same motion paths generated by drive wheels 601, 502 having the range of diameter ratios between about 1:20 through 20:1.

Figure 1:
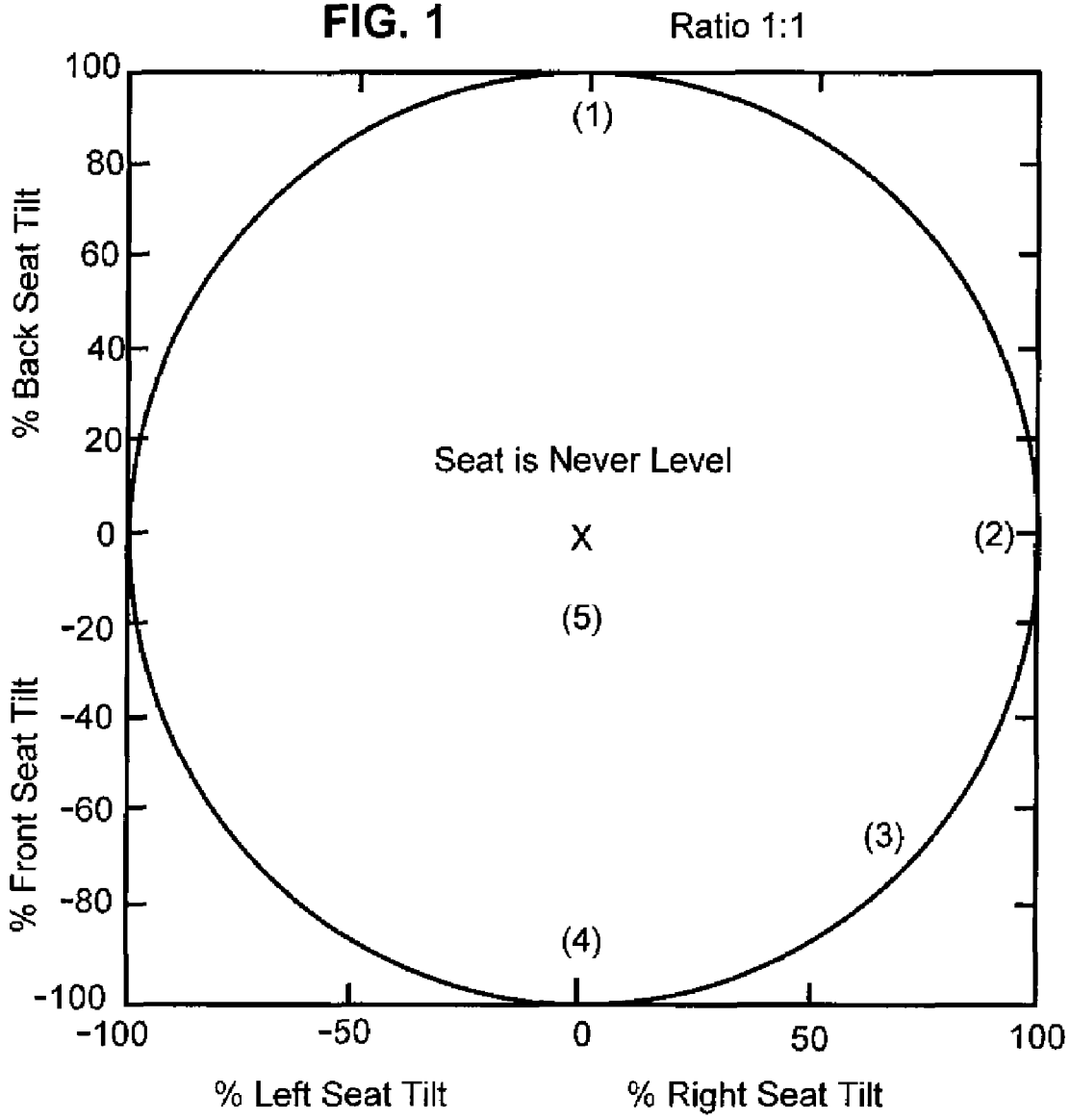
FIG. 1 illustrates a graphical plot of a range of motion in an existing chair.
Figure 2A:
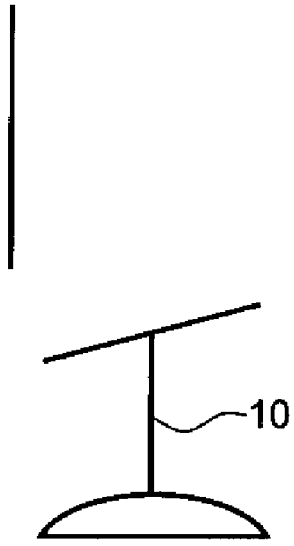
FIG. 2A Prior Art
FIGS. 2A and 2B illustrate a profile view and elevation view, respectively, of a position of an existing chair that corresponds with a point on the plot of FIG. 1 and FIG. 11.
Figure 2B:
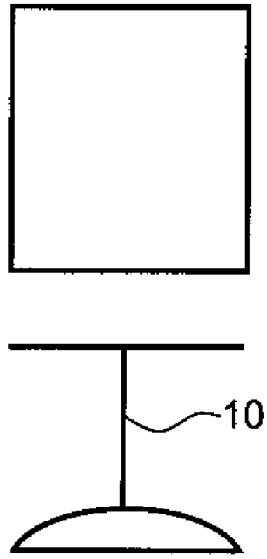
FIG. 2B Prior Art
Figure 3A:
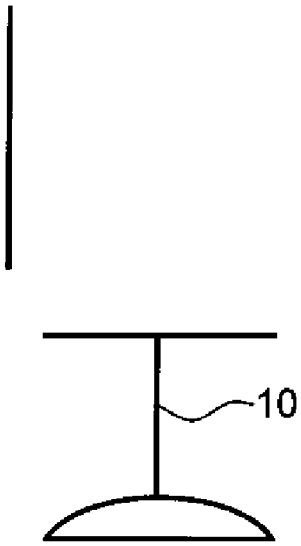
FIG. 3A Prior Art
FIGS. 3A and 3B illustrate a position of an existing chair that corresponds with a point on the plot of FIG. 1
Figure 3B:
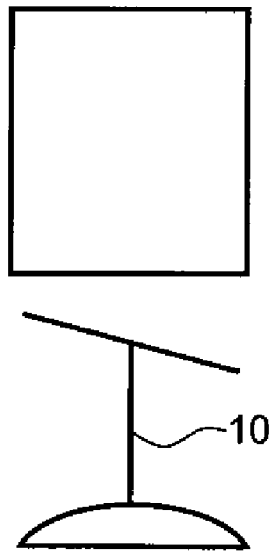
FIG. 3B Prior Art
Figure 4A:
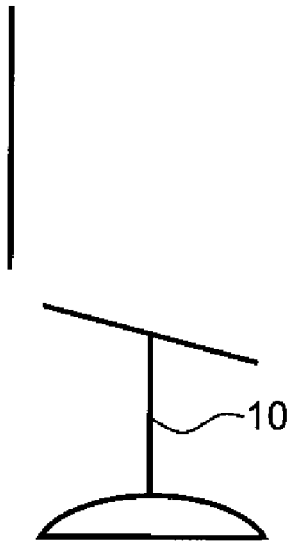
FIG. 4A Prior Art
FIGS. 4A and 4B illustrate a profile view and elevation view, respectively, of a position of an existing chair that corresponds with a point on the plot of FIG. 1 and FIG. 11
Figure 4B:
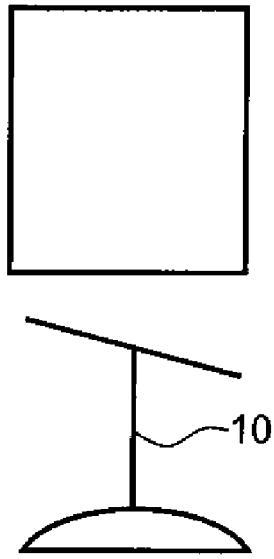
FIG. 4B Prior Art
Figure 5A:
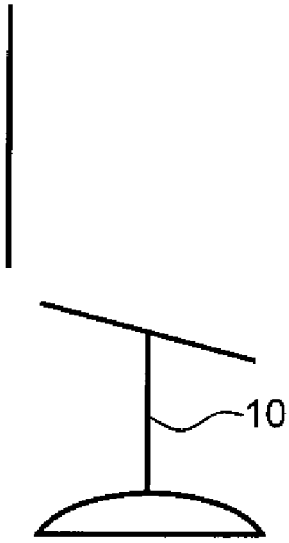
FIG. 5A Prior Art
FIGS. 5A and 5B illustrate a profile view and elevation view, respectively, of a position of an existing chair that corresponds with a point on the plot of FIG. 1 and FIG. 11.
Figure 5B:
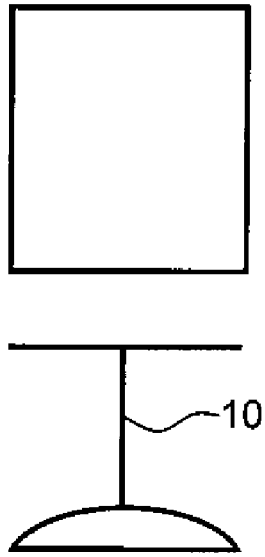
FIG. 5B Prior Art
Figure 6A:
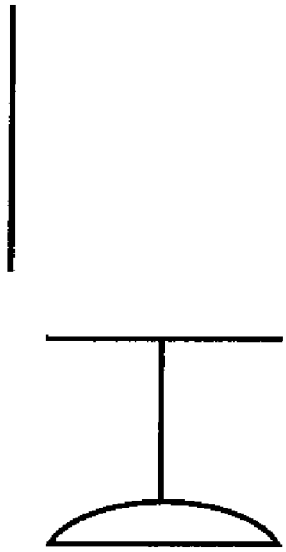
FIGS. 6A and 6B illustrate a profile view and elevation view, respectively, of a position of a chair that corresponds with a level point on the plot of FIG. 1 and FIG. 1.
Figure 6B:
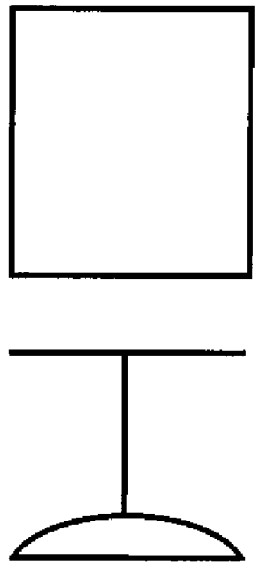
Figure 11:
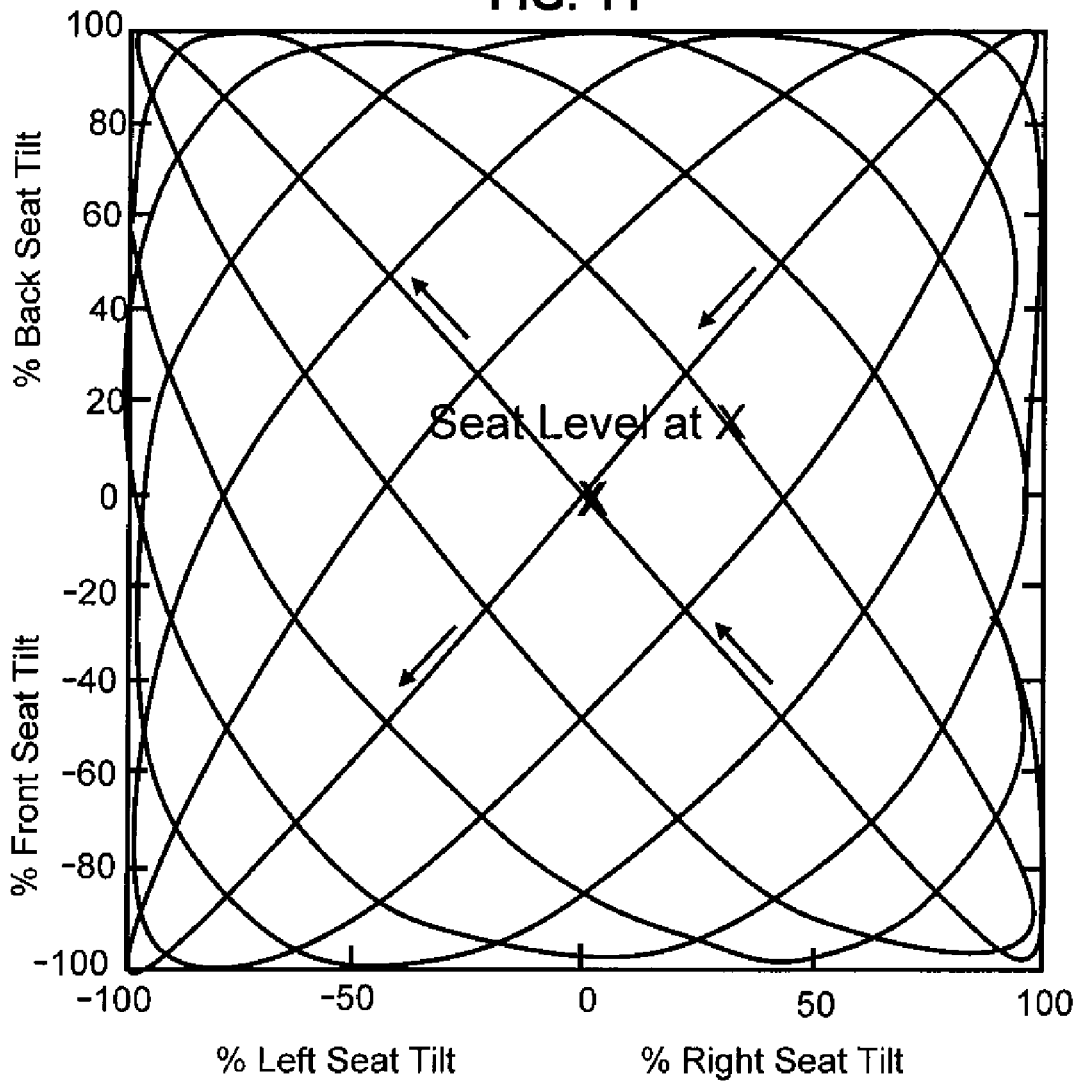
FIG. 11 illustrates a motion path of six cycles of the dynamic chair of the present invention when configured with drive wheels having a 7:6 ratio.
Figure 12:
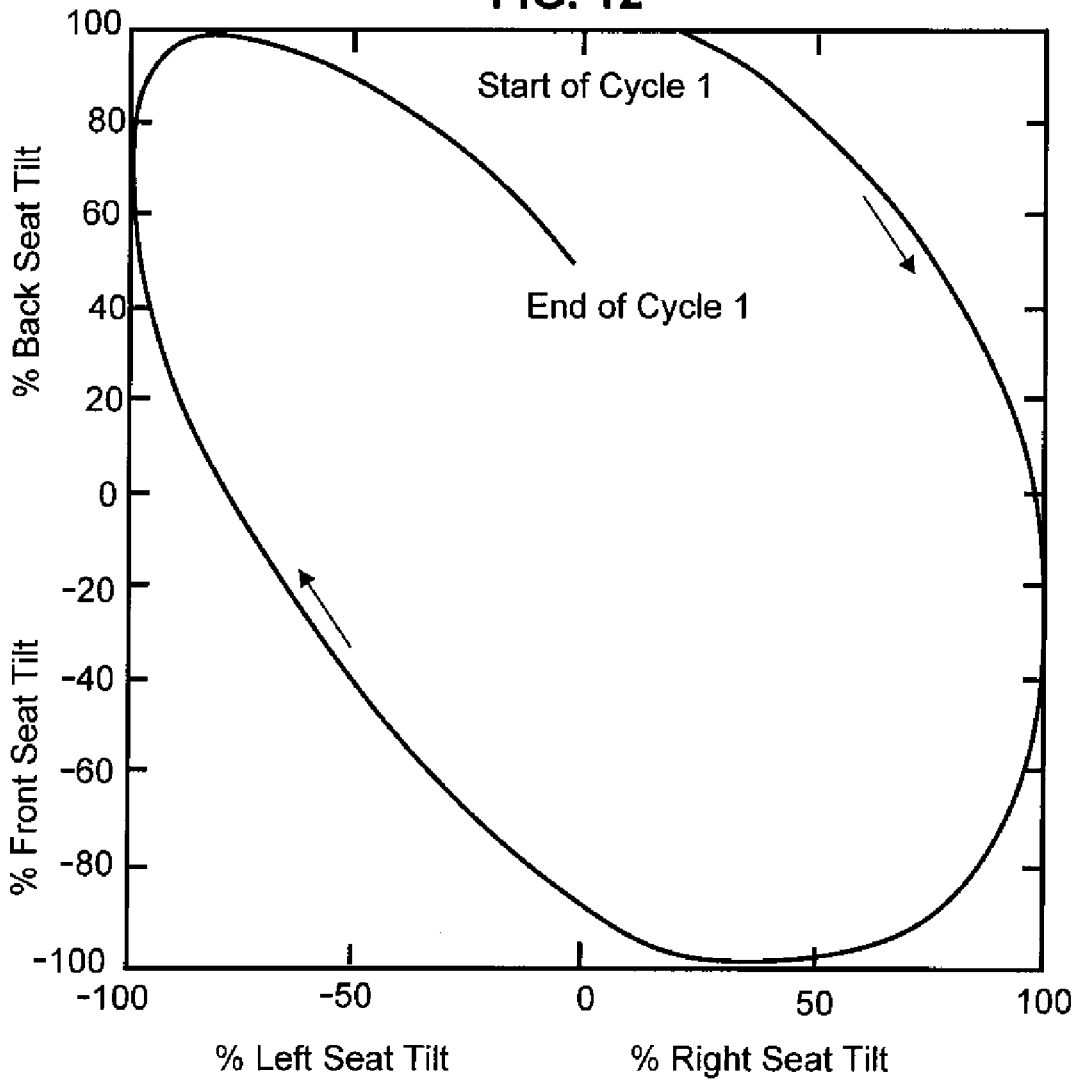
FIG. 12 illustrates a motion path of the first of six cycles of the dynamic chair configured in accordance with FIG. 11.
Figure 13:
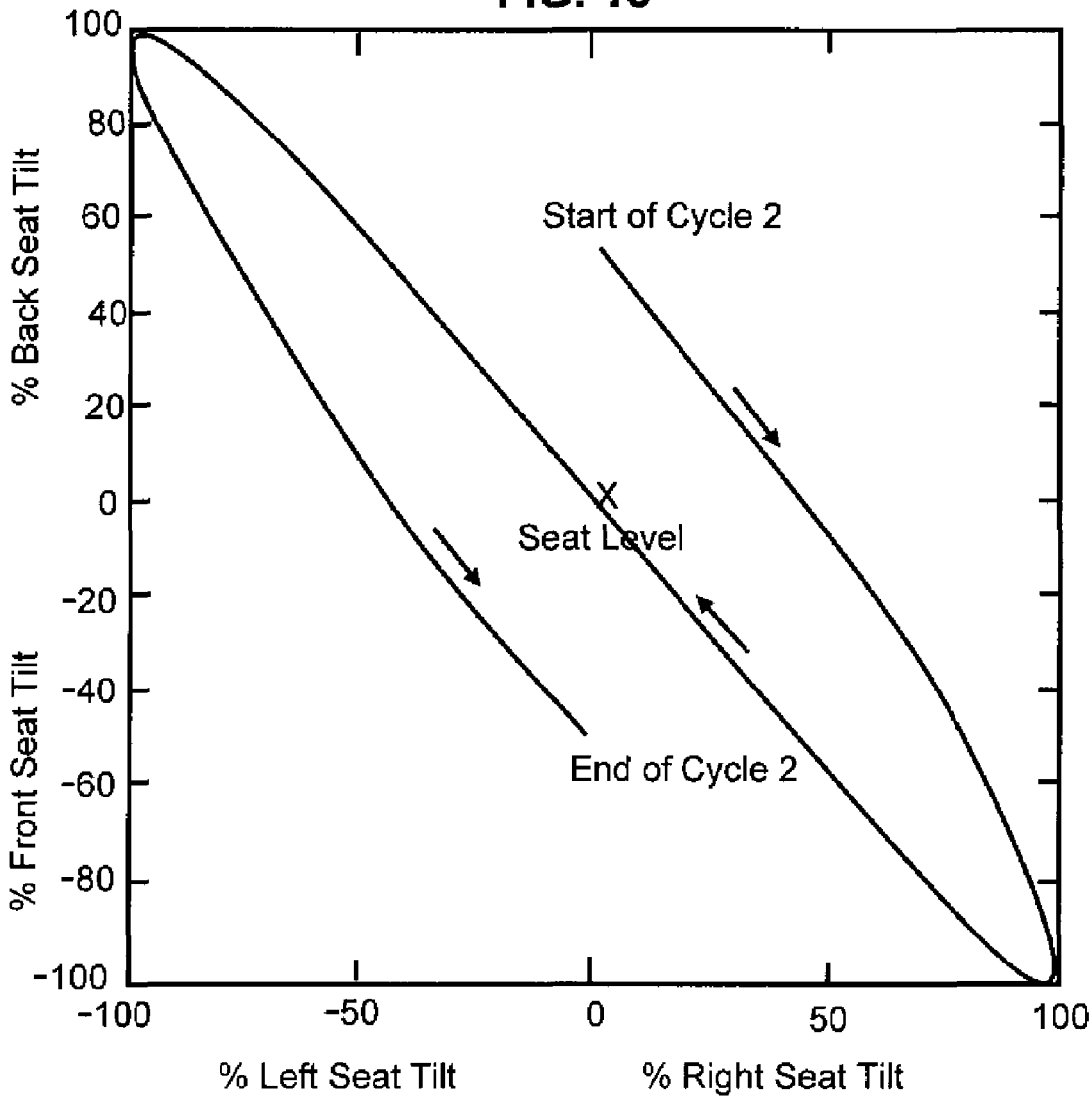
FIG. 13 illustrates a motion path of the second of six cycles of the dynamic chair configured in accordance with FIG. 1.
Figure 14:
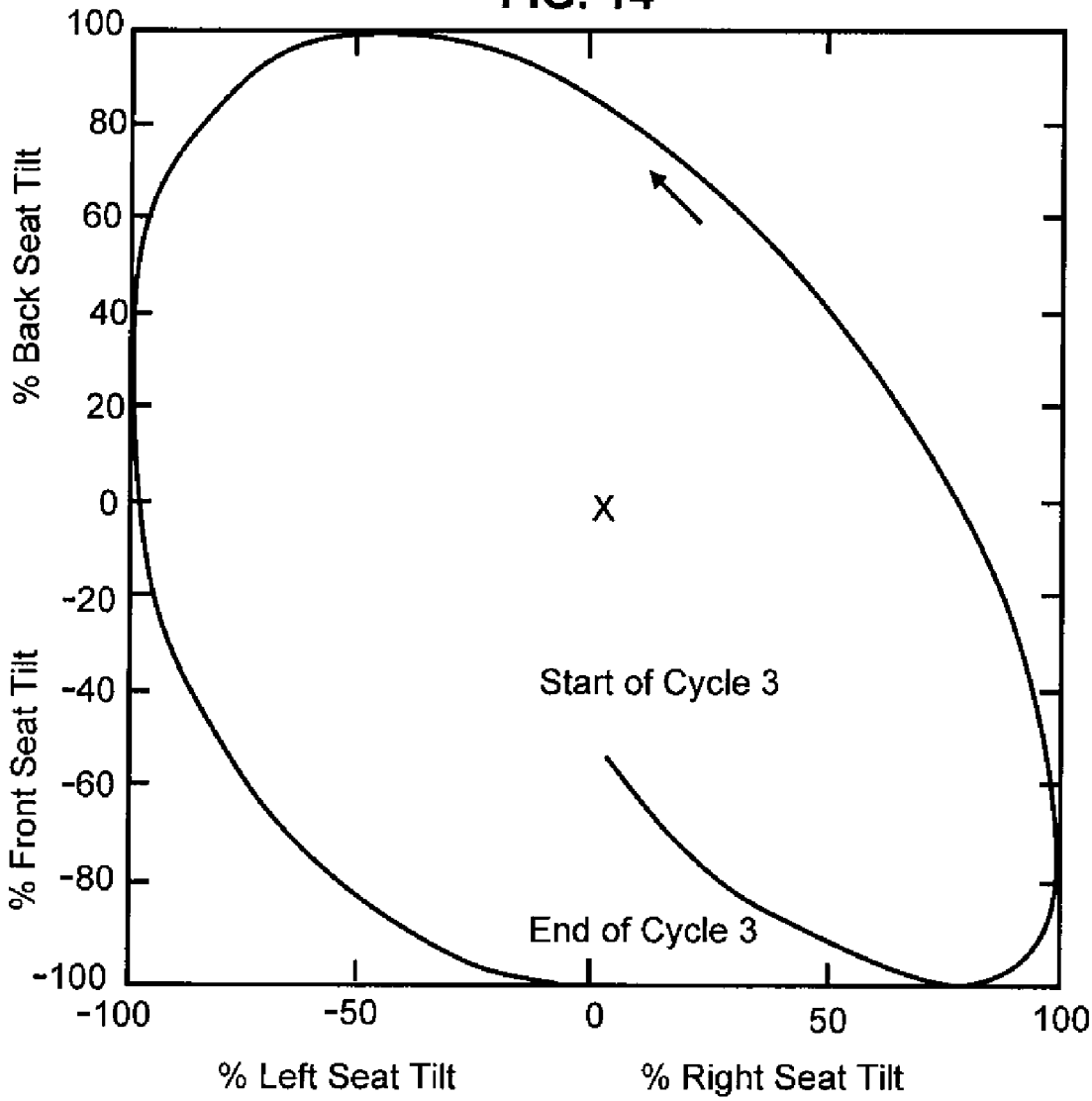
FIG. 14 illustrates a motion path of the third of six cycles of the dynamic chair configured in accordance with FIG. 1.
Figure 15:
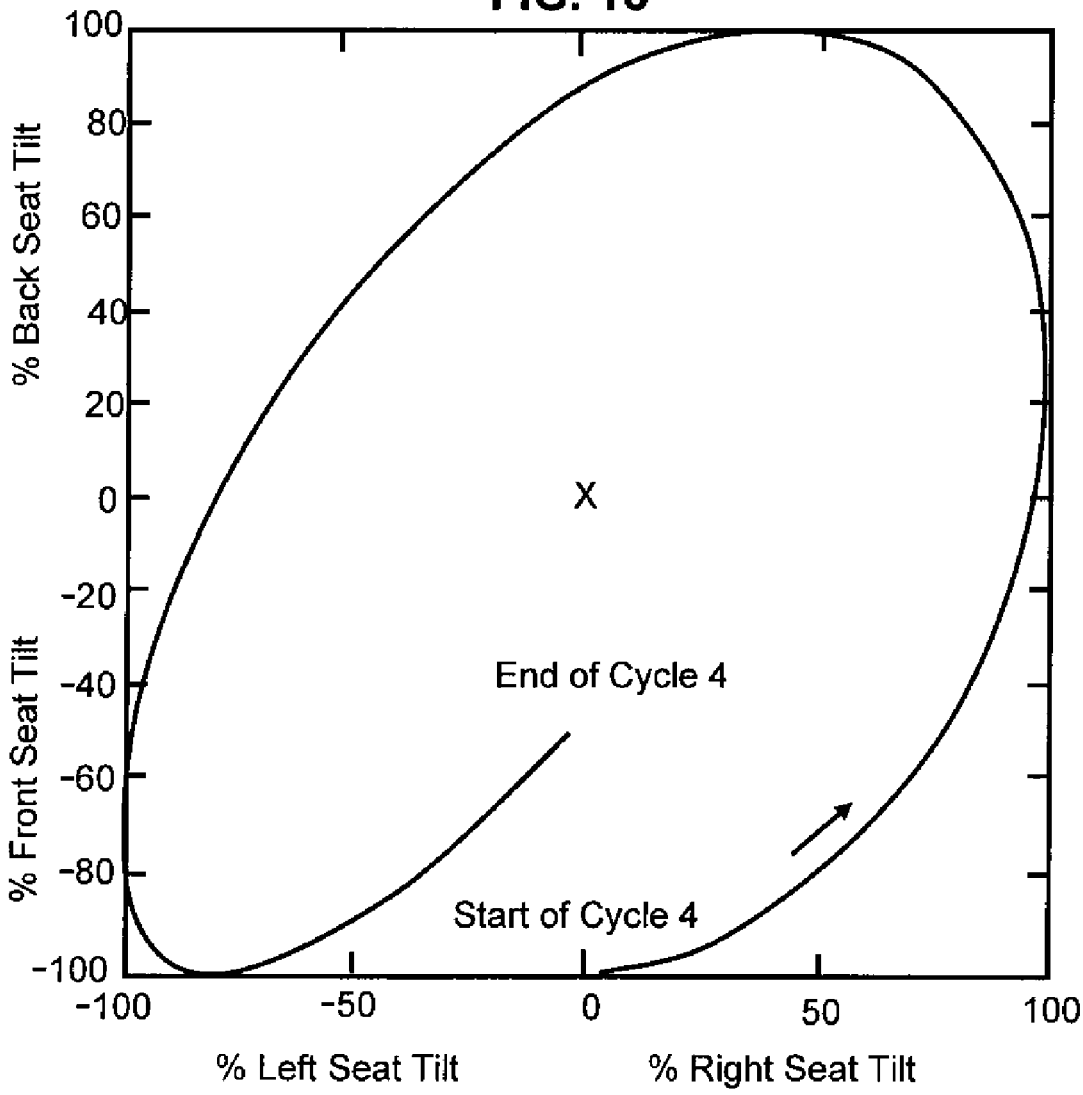
FIG. 15 illustrates a motion path of the fourth of six cycles of the dynamic chair configured in accordance with FIG. 1.
Figure 16:
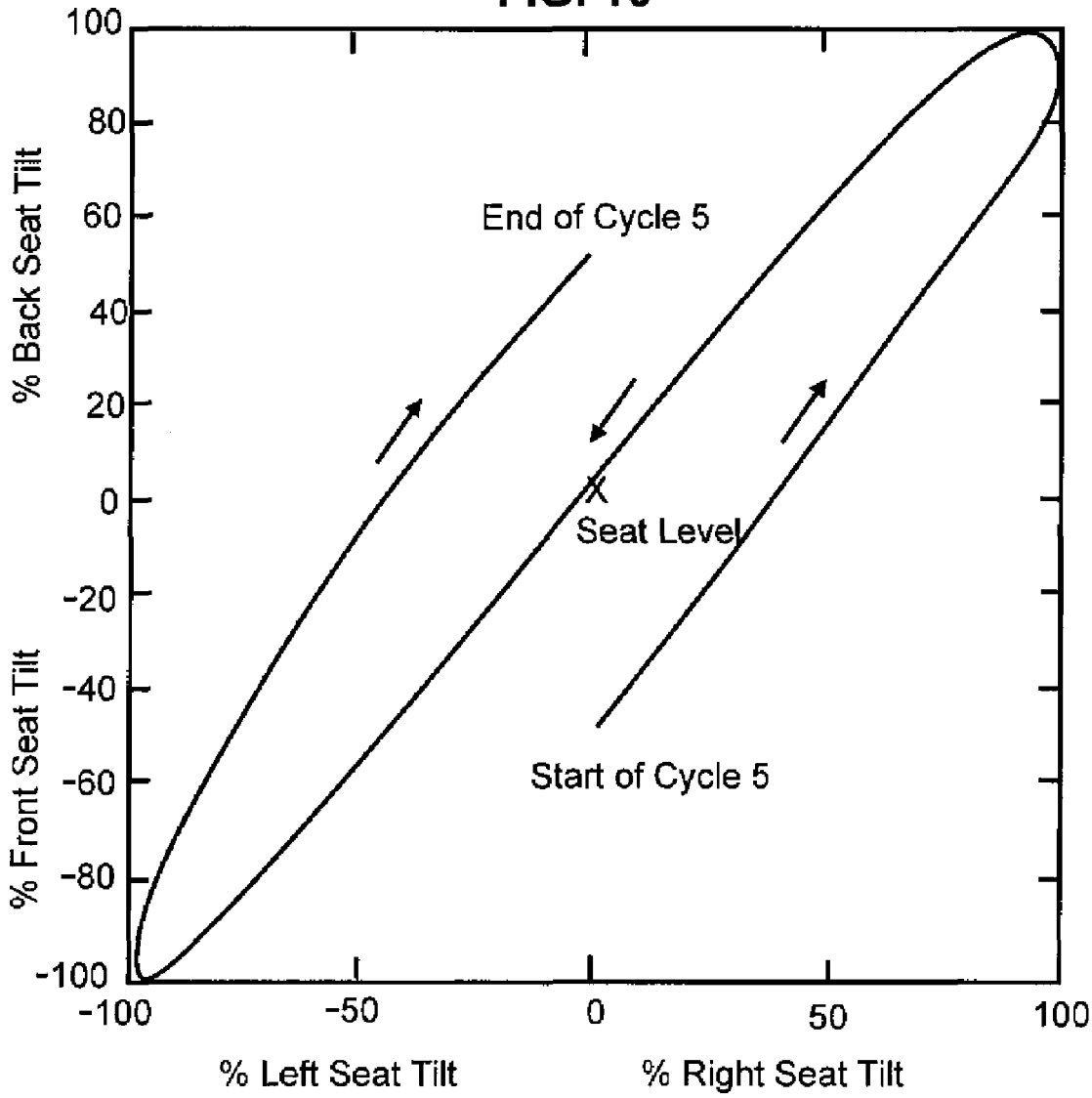
FIG. 16 illustrates a motion path of the fifth of six cycles of the dynamic chair configured in accordance with FIG. 1.
Figure 17:
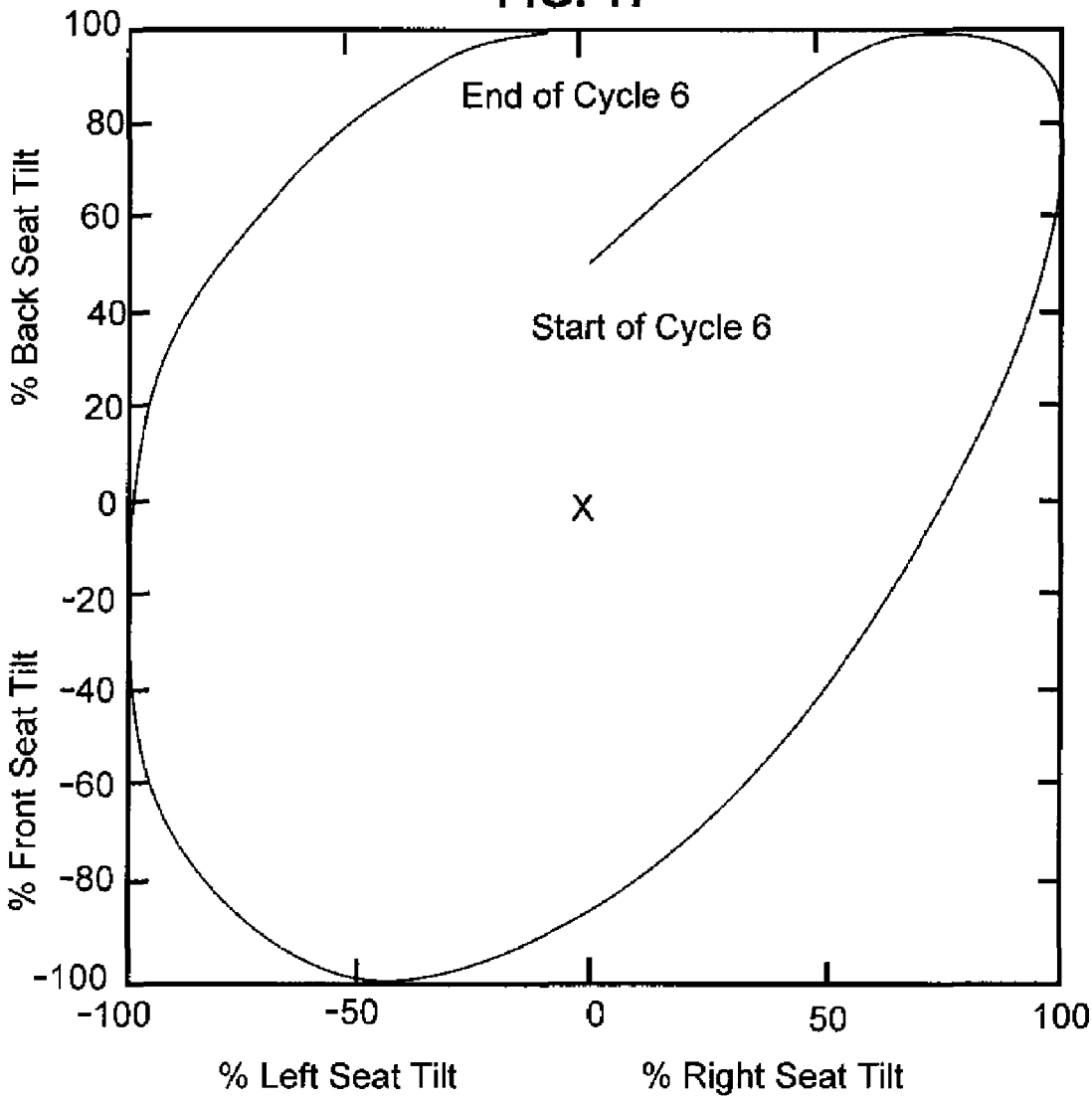
FIG. 17 illustrates a motion path of the sixth of six cycles of the dynamic chair configured in accordance with FIG. 1.
Figure 18:
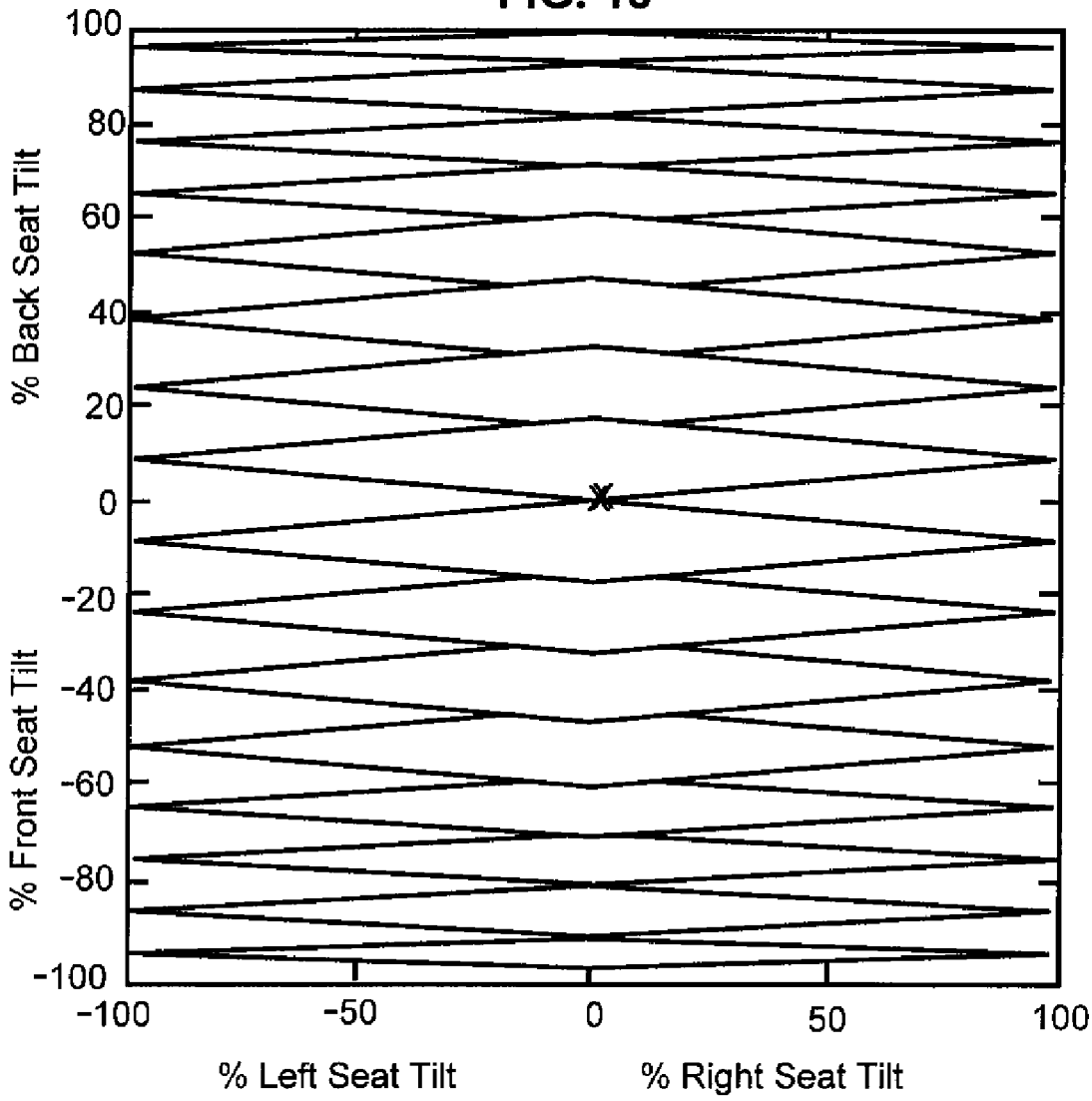
FIG. 18 illustrates a motion path of 20 cycles of the dynamic chair of the present invention when configured with drive wheels having a 1:20 ratio.
Figure 19:
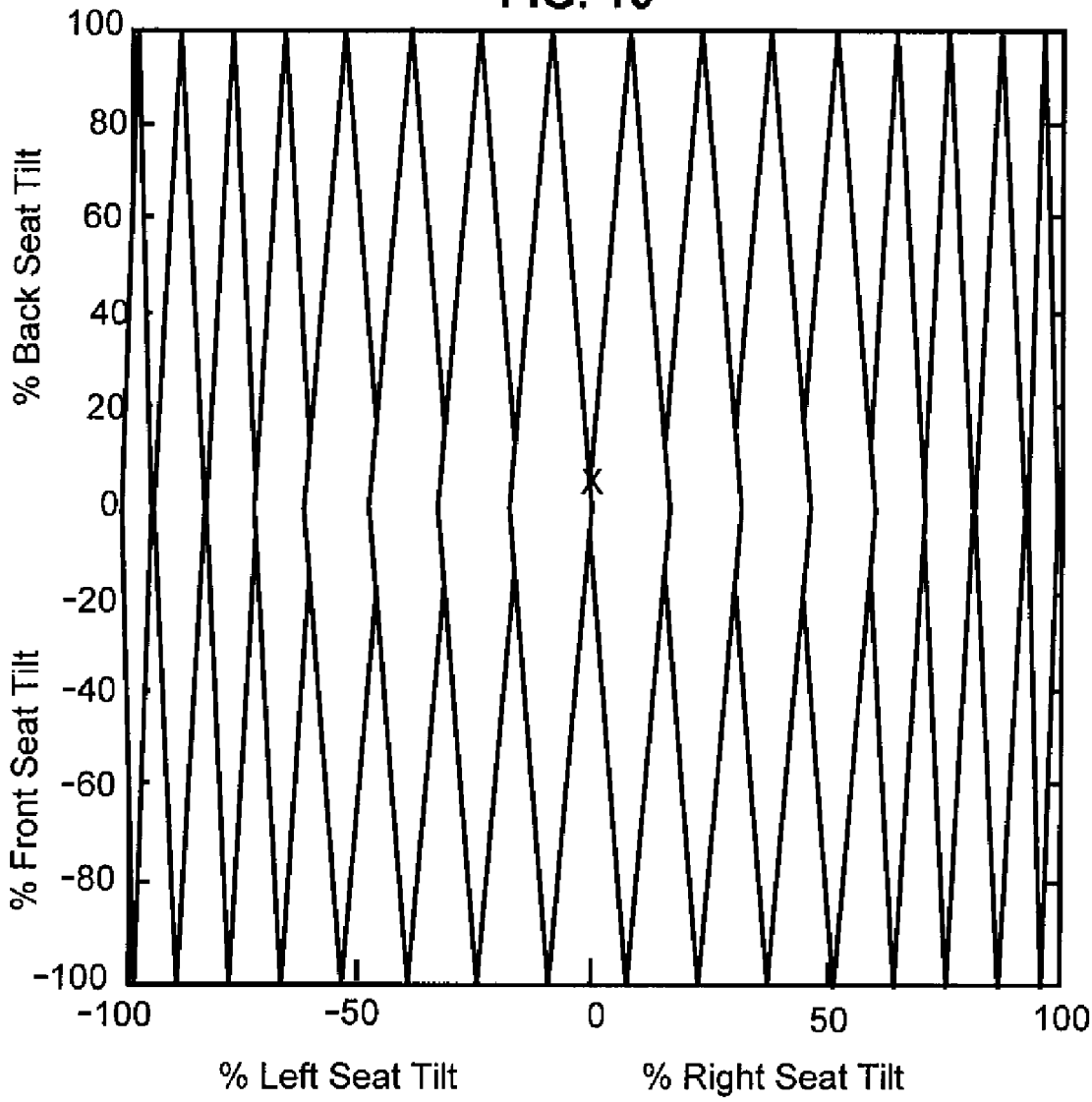
FIG. 19 illustrates a motion path of 20 cycles of the dynamic chair of the present invention when configured with drive wheels having a 20:1 ratio.

The motion paths generated in the present invention cause seat 200 to tilt between a level, horizontal position and various tilted positions. The periodic deterministic and repeatable complex motion path generated by the present invention allows seat 200 to tilt in a much larger range of positions than the circular path methods of the prior art. This complex tilting path is illustrated in a graphical plot in FIG. 11. As shown in FIG. 11, seat 200 is moved in accordance with a Lissajou pattern. To generate the path in FIG. 11, a drive wheel ratio of 6:7 was used. This path consists of six cycles. A more detailed graphical representation of each cycle of this path is shown in FIG. 12 through FIG. 17. Directing attention to FIG. 11 the X indicates the location where seat 200 is level. With a ratio of 7:6 the seat becomes level twice during the six angular path cycles this ratio generates. This ratio metric angular motion path has the ability to reverse direction without reversing the direction of the motor. In FIG. 13, the direction of the angular motion changes from clockwise to counter clockwise and reverses again to clockwise in FIG. 16. Comparing FIG. 11 to the angular path of the prior art in FIG. 1, it should be obvious the angular path of this invention provides a much larger range of angular motions than the prior art circular motion method. While ratio of 7:6 was used in this invention, a much larger set of other ratios will generate many desirable angular motion paths. Different ratio metric ratios will produce different repeating angular paths and a different number of cycles before the pattern repeats.

Figure 10:
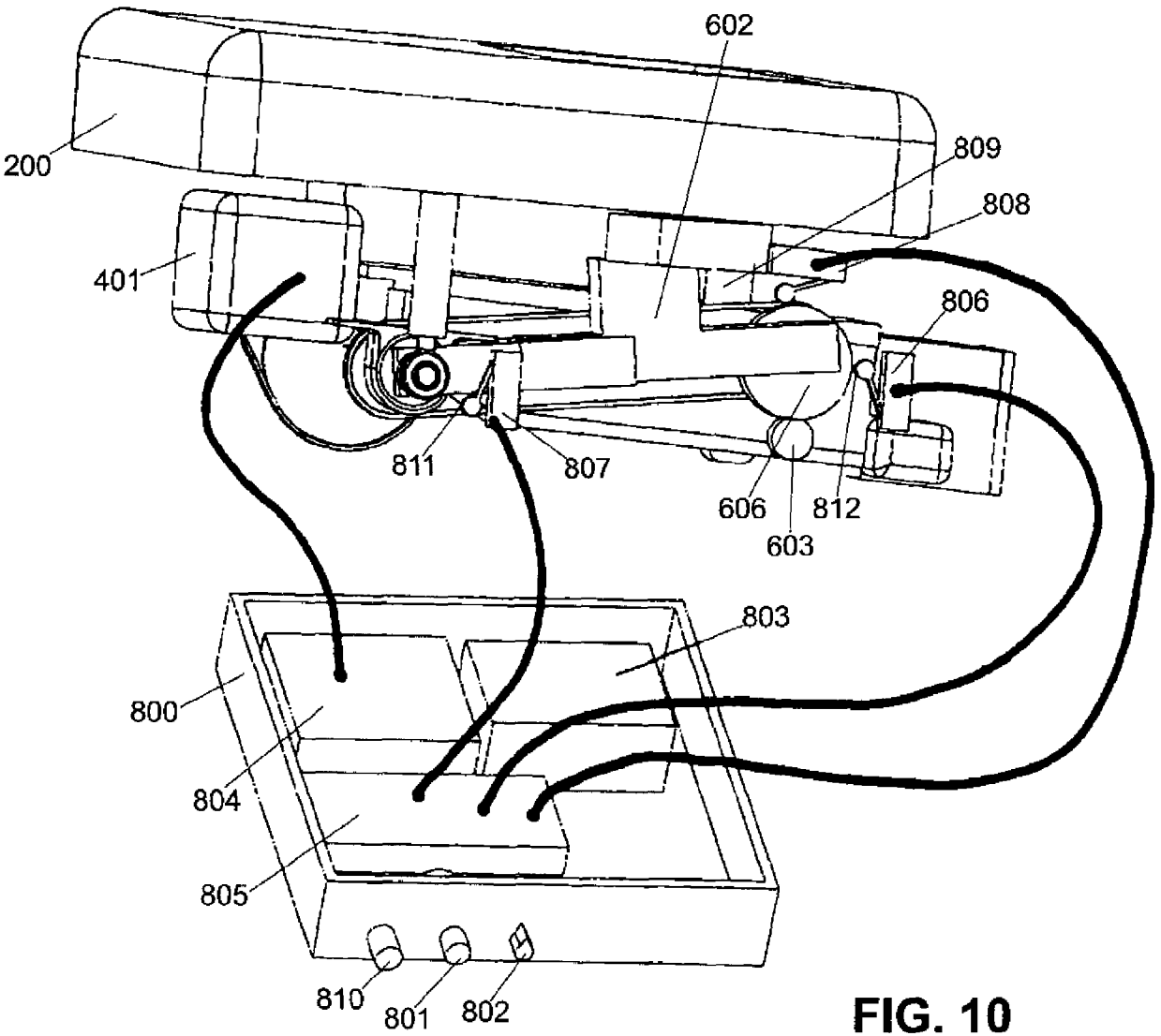
FIG. 10 illustrates the motor drive assembly and sensors connected to the chair electronic controller.

Directing attention to FIG. 10, in an embodiment, motor 401 and the motion of seat 200 are controlled by controller 800. Controller 800, which has a variable speed adjustment control 801 connected to motor driver 804. In an embodiment, motor timer 803, which provides periods where motion of seat 200 is temporarily suspended. This allows the motion to be stopped for periodic rest times and thus constant postural changes are not required.

In an embodiment, the present invention detects when seat 200 is level with respect to pitch and roll. To detect when seat 200 is level, two horizontal seat sensors 806, 807 are disposed approximate to first and second level seat detection points 812, 811. Sensor 807 determines when seat 200 is horizontal with respect to left/right tilt. Sensor 806 determines when seat 200 is horizontal with respect to front/back tilt. In an embodiment, sensor 806, 807 utilizes a stationary, mechanically activated electrical switch such as a limit switch. Sensors 806, 807 are triggered when detection points 812, 811, makes contact with sensors. Microcomputer 805 detects when sensors 806, 807 make contact and when sensors lose contact with detection points 811, 812. When level seat sensors both 806, 807 make or loses contact within 0.2 seconds of each other, seat 200 is declared level with respect to pitch and roll. spectfully within 0.2 seconds.

In an embodiment, when motor timer 803 is in the SEAT ON mode, motor 401 is powered on. When motor timer 703 is in the SEAT OFF mode and horizontal seat sensors 806, 807 and microcomputer 805 detects level seat, motor 401 us turned off. The timer allows for periodic no motion time off periods.

In an embodiment, microcomputer 805 contains logic that allows an adjustable time interval, starting when a level seat is detected and motor 401 is powered off. This is especially useful for accommodating individual needs such as an injury where the seated person finds comfort in a slightly off-level position.

In an embodiment, when seat is empty, spring 809 raises tilt arm 602, thus lifts cam 606 off of cam follower 603. When cam 606 is lifted off of cam follower it de-activates seated person sensor 808 and turns off motor. When seat is occupied seated person sensor 808 is activated and enables motor.

In an embodiment, the motor 401 may be turned off with switch 810. This allows the chair to be used as a regular non-moving chair.

While in a preferred embodiment, the motor speed is adjustable. With a useful range of seat cycling from 0.1 to 20 rpm. In another embodiment the motor can have a fixed speed, within the above useful range, thus eliminating the motor driver 804 and speed adjustment control 801.

While in a preferred embodiment, the dynamic chair is controlled by a microcomputer controller. In another embodiment the dynamic chair can be controlled by a single on/off switch, thus eliminating all electronic components except the motor 401 and the on/off switch 810.

In a preferred embodiment, Chair motion parameters may be computer controlled using the following programmable parameters: Selection of continuous motion or segmented distance moves with stop periods. Length of distance between stop periods. Length of time during stop period. Programmable speeds over time. Reversing the direction of motion path. Periodic stopping in a level position. Selector switch 802 allows for selection of various motion programs.

While the preferred embodiment of the present invention uses a drive wheel ratio of 6:7, reversing this ratio to 7:6 will yield similar results. While chair 100 is illustrated herein as a conventional chair, chair 100 is also particularly useful when incorporated into the design of a wheelchair, and is also useful in vehicles such as automobiles, trucks, airplanes, or other applications where a person remains seated for prolonged periods of time.

While the preferred embodiment of the present invention uses two eccentrics FIG. 8C 507,508 with attached rod ends 509, 510 and cam 606 to generate motion in the seat 200, other combination of offset generating means such a different combinations of eccentrics with rod ends, cams and crankshafts cam be employed to generate motion of a chair seat.

While various embodiments of the dynamic chair of the present invention have been described and illustrated in detail, it is to be understood that many changes to the embodiments can be realized without departing from the spirit of the invention.

What is claimed is:

1. A dynamic chair providing automatic motion in a seat, the chair comprising:

a chair base with center support;

a seat having a bottom;

a drive motor;

a first motor drive wheel, the first motor drive wheel driven in a rotational manner by the drive motor;

a first drive wheel belt, the first drive wheel belt driven by the first motor drive wheel;

a second speed modification drive wheel, the second speed modification drive wheel driven in a rotational manner by first drive wheel belt;

a drive shaft, the drive shaft driven by the speed modification drive wheel;

a third drive wheel, the third drive wheel attached to and driven by the drive shaft;

a second drive wheel belt, driven by the third drive wheel;

a fourth drive wheel driven by the second drive wheel belt;

a cam connected parallel to and driven by the fourth drive wheel, the cam having a center of rotation, a high point daring the cam's rotation and a low point of the cam's rotation a first offset distance substantially equal to the difference of the distance from the high point of the cam to the cam's center of rotation and the distance from the low point of the cam to its center of rotation;

a left eccentric and a right eccentric, the left and right eccentric attached to opposite ends of the drive shaft and opposed 180 degrees from each other with respect to rotation about the cam;

a second offset distance which is the sum of the distances from the offset mounting points and to the center of rotation of each eccentric;

a first control means providing a first rotational degree of freedom of movement to the seat, the first control means transferring motion to a tilt bearing guide, the tilt bearing guides attached near the center rear portion of the seat's bottom; and a second control means providing second and third rotational degrees of freedom of movement to the seat, the second control means attached to mounting points on the left and right eccentrics, respectively, to mounting locations on a forward location of the seat's bottom, wherein the third and fourth drive wheels are configured in an unequal ratio of diameters within a range of 20:1 and 1:20, such that a changing, substantially ellipsoidal tilting pattern of movement is produced in the seat bottom.

2. The dynamic chair of claim 1, first and second control means are offset 90 degrees from each other with respect to the center of chair seat rotation.

3. The dynamic chair of claim 1, wherein the first offset distance determines a range of rotation of the seat's first rotational degree of freedom, the second offset distance determines a range of rotation of the seat's second rotational degree of freedom and a third rotational degree of freedom, said first, second and third ranges being within −5 degrees to +5 degrees.

4. The dynamic chair of claim 1, wherein the first motor drive wheel, second speed modification wheel, third drive wheel and fourth drive wheels comprise pulleys and are connected to each other by drive belts.

5. The dynamic chair of claim 1, wherein the first motor drive wheel, second speed modification wheel, third drive wheel and fourth drive wheels comprise sprockets and the first drive wheel belt and second drive wheel belt comprise roller chains.

6. The dynamic chair of claim 1, wherein a vertical distance exists between the top of seat and the seat's center of rotation, the vertical distance defining a first degree of linear freedom of horizontal movement for the seat and a second degree of linear freedom of horizontal motion for the seat, the first degree of freedom of linear motion orthogonal to the second degree of freedom of linear movement.

7. The dynamic chair of claim 1, wherein the third rotational degree of freedom is defined by a change in horizontal distance between the first eccentric and second eccentric, the change in horizontal distance occurring during rotation of the drive shaft.

8. The dynamic chair of claim 1, wherein the first control means comprises a first length, and the second control means comprises a second and third length, the first length defining a front to back mean angle of the seat, the second length defining a left to right mean angle of the seat.

9. The dynamic chair of claim 1, wherein the second control means comprises first and second linkages, the first and second linkages being adjustable to allow for left to right tilt adjustment.

10. The dynamic chair of claim 1, wherein the drive motor comprises a variable speed drive motor.

11. The dynamic chair of claim 1, further comprising a motor timer, the motor timer providing periodic motor stop time.

12. The dynamic chair of claim 1, further comprising a plurality of level sensors, wherein the motor timer provides periodic stop time in conjunction when the seat is level with respect to pitch and roll.

13. The dynamic chair of claim 1, further comprising a seated person sensor, which inhibits the motor when chair is empty, and enables motor when chair is occupied.

14. The dynamic chair of claim 1, further comprising a microcomputer that controls a variety of selectable motion path variations which include but not limited to changing speeds, start and stop points in relation to level chair position, changing motor direction, and variations of periodic start and stop times.

15. The dynamic chair of claim 1, further comprising a power switch, said power switch controlling power supplied to the dynamic chair.

16. The dynamic chair of claim 1, further comprising a power switch and a fixed speed motor, which, when used together, controls a motion path generated by the chair.

17. The dynamic chair of claim 1, further comprising a backrest and two armrests, the backrest and armrests stationary with regard to tilting, rotational and linear motion of the seat.

* * * * *